US010051391B2

(12) United States Patent
Henriksen

(10) Patent No.: US 10,051,391 B2
(45) Date of Patent: Aug. 14, 2018

(54) SPACER AND HEARING DEVICE COMPRISING IT

(71) Applicant: OTICON A/S, Smørum (DK)

(72) Inventor: Poul Henriksen, Smørum (DK)

(73) Assignee: OTICON A/S, Smørum (DK)

( * ) Notice: Subject to any disclaimer, the term of this patent is extended or adjusted under 35 U.S.C. 154(b) by 2 days.

(21) Appl. No.: 15/204,647

(22) Filed: Jul. 7, 2016

(65) Prior Publication Data

US 2017/0013375 A1 Jan. 12, 2017

(30) Foreign Application Priority Data

Jul. 8, 2015 (EP) ..... 15175852

(51) Int. Cl.
*H04R 25/00* (2006.01)

(52) U.S. Cl.
CPC ..... *H04R 25/65* (2013.01); *H04R 2225/023* (2013.01); *H04R 2225/51* (2013.01); *H04R 2460/11* (2013.01); *H04R 2460/17* (2013.01)

(58) Field of Classification Search
CPC ..... H04R 25/65; H04R 2225/023; H04R 2225/51; H04R 2460/11; H04R 2460/17
USPC ..... 381/328
See application file for complete search history.

(56) References Cited

U.S. PATENT DOCUMENTS

| | | | | |
|---|---|---|---|---|
| 5,381,484 | A * | 1/1995 | Claes | H04R 25/00 381/23.1 |
| 5,721,783 | A * | 2/1998 | Anderson | H04B 1/385 381/312 |
| 2008/0056520 | A1* | 3/2008 | Christensen | H01Q 1/273 381/323 |
| 2013/0101147 | A1* | 4/2013 | Kraemer | H04R 1/1016 381/322 |
| 2013/0136285 | A1* | 5/2013 | Naumann | H04R 1/1016 381/329 |
| 2014/0270191 | A1 | 9/2014 | Nikles | |
| 2015/0016645 | A1* | 1/2015 | Bauman | H04R 25/554 381/315 |
| 2015/0063612 | A1* | 3/2015 | Petersen | H04R 25/453 381/313 |
| 2015/0271609 | A1* | 9/2015 | Puria | H04R 25/456 381/328 |

FOREIGN PATENT DOCUMENTS

| | | | |
|---|---|---|---|
| EP | 2 076 065 | A1 | 7/2009 |
| JP | 10-294998 | A | 11/1998 |
| WO | WO 2013/016589 | A1 | 1/2013 |
| WO | WO 2013/016589 | A4 | 1/2013 |

* cited by examiner

*Primary Examiner* — Sean H Nguyen
(74) *Attorney, Agent, or Firm* — Birch, Stewart, Kolasch & Birch, LLP

(57) ABSTRACT

A spacer attached to or being configured to be attached to a pull-out string for a hearing device is disclosed. The spacer comprises a contact portion adapted for being brought into contact with the wall of the ear canal of a hearing device user and hereby maintain the pull-out string in a distance from the wall of the ear canal.

20 Claims, 5 Drawing Sheets

Fig. 3C
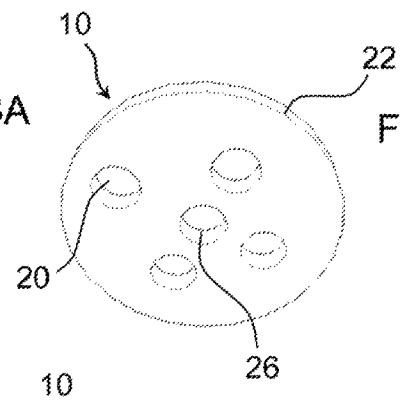
Fig. 3A
Fig. 3B
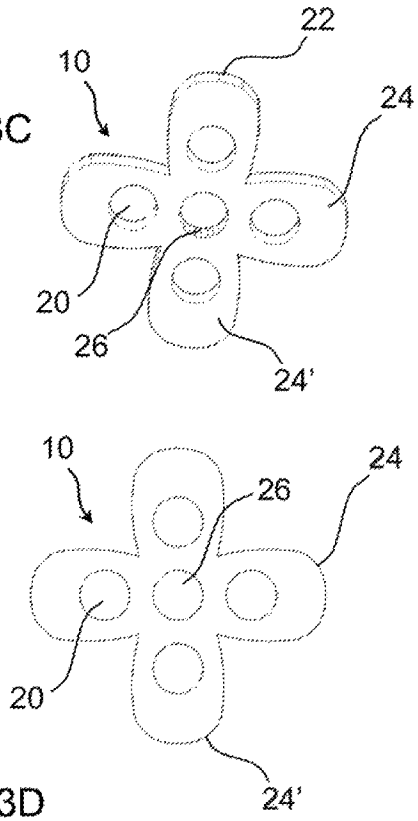
Fig. 3D
Fig. 3E
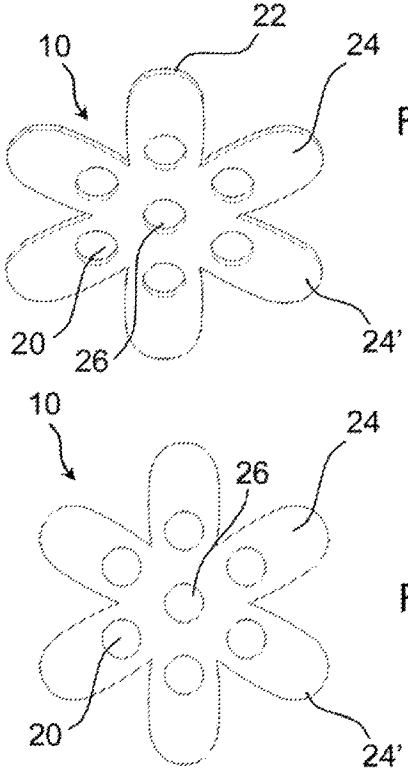
Fig. 3F

SPACER AND HEARING DEVICE COMPRISING IT

FIELD OF DISCLOSURE

The present disclosure relates to a spacer attached to or being configured to be attached to a pull-out string for a hearing device. The disclosure also relates to a hearing device comprising such spacer.

BACKGROUND

Some of the least visible of the hearing devices are the Completely-In-the-Canal (CIC) hearing devices that are configured to be arranged deeply into the ear canal. A pull-out-string (also referred to as an "extractor cord') may be added to the hearing device to pull it out more easily. Some of these pull-out strings are provided with an antenna.

Due to the variation of ear canals among individuals, it is often difficult to control, or anticipate, the position of the pull-out string relative to the ear canal, and in case the pull-out string comprises an antenna, the distance from the antenna and the wall of the ear canal or whether the pull-out string will abut the ear canal wall. Accordingly, it is likely that the antenna transfers energy via antenna coupling to the ear canal wall tissue. One effective way to decrease this energy coupling is to increase the separation between the antenna and the ear canal wall tissue.

Therefore, it is desired to position the antenna in a minimum distance from the walls of the ear canal. The present disclosure provides as least an alternative to the prior art.

SUMMARY

According to an aspect of the disclosure, the spacer is a spacer attached to or being configured to be attached to a pull-out string of a hearing device, wherein the spacer comprises a contact portion adapted for being brought into contact with the wall of the ear canal of a hearing device user and hereby maintain the pull-out string in a distance from the wall of the ear canal.

Hereby, the spacer may be used to maintain the pull-out string in a desired position relative to the wall of the ear canal (a position in which a minimum distance to the wall of the ear canal is achieved). Accordingly, it is possible to prevent (to reduce) the antenna from transferring energy via antenna coupling to the ear canal wall tissue.

The spacer may be either attached to a pull-out string or be adapted to be attached to a pull-out string for a hearing device.

The spacer comprises a contact portion that is adapted to be brought into contact with the wall of the ear canal of a hearing device user and hereby maintain the pull-out string in a distance from the wall of the ear canal.

The contact portion is a portion that is configured to bear against the wall of the ear canal of a hearing device user. When the contact portion has been brought into physical contact with the wall of the ear canal of a hearing device user, the spacer will prevent further displacement of the pull-out string in that direction.

The contact portion is part of the periphery of the spacer. The periphery (defining the outermost portion of the spacer) may, however, comprise both the contact portion and a "non-contact portion". A concave portion of the periphery would constitute a "non-contact portion". On the other hand, at least a portion of a convex portion of the periphery may constitute a contact portion. It is important to underline that a part of a convex portion of the periphery may constitute a "non-contact portion".

According to another aspect of the disclosure, the spacer has a round or oval periphery.

By providing the spacer with a round or oval periphery, it is possible to ensure that the contact portion of the spacer is comfortable. A round or oval periphery provides a smooth contact surface without pointed structures that may introduce the risk of damaging the ear canal.

According to yet another aspect of the disclosure, the spacers comprise a plurality of radially extending arm members.

Hereby, the spacer will automatically be provided with vent areas allowing audio signals to pass freely through the spacer. The vent area will be the area provided between the arm members.

The arm members may be arranged to extend in the same plane and hereby constitute a plane geometrical shape.

According to a further aspect of the disclosure, the spacer is transparent to audio frequency sound waves.

Hereby, the spacer will not negatively affect the hearing experience for the user of the hearing device.

It is possible to ensure that the spacer is transparent to audio frequency sound waves by providing openings in the spacer or by providing other vent areas allowing audio signals to pass freely through the spacer.

The spacer may be provided with a number of vent holes. The vent holes may preferably have a size and geometry allowing audio signals to pass freely through the spacer.

The hearing device may comprise a pull-out string and at least one spacer, wherein an antenna is arranged in connection with the pull-out string or integrated in the pull-out string. Hereby, the hearing device may be configured to prevent the antenna from transferring energy via antenna coupling to the ear canal wall tissue. This may be accomplished by using the spacer to maintain the pull-out string in a desired position relative to the wall of the ear canal.

The hearing device may comprise a body portion, wherein the antenna extends at least partly through the length of the pull-out string and where the antenna extends through at least a portion of the body portion of the hearing device. The body portion may be a housing.

Hereby, the distance between the antenna and the receiver or speaker may be so large that it is (at least partly) possible to ensure that the antenna will not pick up unwanted electromagnetic radiation. Further, at least a portion of the antenna may be coiled, e.g. inside the housing. The housing may be custom made for the user, or have a size suitable for the ear canal without blocking the ear canal. The housing may comprise a dome or other suitable adaptation device for, at least, partly retaining the housing in the ear canal, and, at least partly, positioning the housing relative to the ear canal. The adaptation device may cover the most of the housing. The adaptation device could be attached at the end of the housing that is to be positioned nearest the ear drum of the wearer, where a part of the adaptation device that is to abut the ear canal extends in a direction along the length of the housing, possibly without extending over the housing, possibly while extending less than 10% of the length of the housing, possibly while extending along around 50% of the length of the housing. Multiple adaptation devices may be present.

One or more wax filters may be included to ensure that cerumen does not block the output from the hearing aid device or even compromise the output device or the hearing aid device. The wax filter may be exchangeable, and may be integrated in a dome or the like, which may be exchangeable, whereby the two parts are exchanged at the same time.

The pull-out-string may have a round or oval periphery. Hereby, a comfortable contact with the pull-out-string may be achieved.

The pull-out-string may be provided with a nail grip in its distal end. This may ease the extraction of the hearing device from the ear canal.

At least one spacer may be fixedly attached to the pull-out string. By fixedly attaching one or more spacers to the pull-out string, a fixed position of the spacers relative to the pull-out string may be achieved. Accordingly, an optimum, and predefined, position of the spacers may be maintained.

At least one spacer may be moveably attached to the pull-out string. Hereby, it is possible to adjust the position of the at least one spacer relative to the pull-out string. Accordingly, individual adjustments may be carried out, thereby increasing the comfort for the user.

The pull-out string may comprise a spacer fixed to the pull-out string by means of a number of attachment portions provided on the pull-out string and a number of corresponding engaging attachment portions provided at the spacer. Hereby, it is possible to provide a mechanical attachment of the spacer to the pull-out string. It may be preferred that the mechanical attachment of the spacer to the pull-out string is detachable.

One or more spacers may be rotatably attached to the pull-out string. Hereby, it is possible to rotate the spacers relative to the pull-out string. Accordingly, the orientation of the spacers relative to the pull-out string may be changed.

The pull-out string may comprise a threaded portion, wherein one or more spacers comprise a threaded bore configured to engagingly receive the threaded portion of the pull-out string. Hereby, it is possible to provide a valid and expedient way of attaching the spaces to the pull-out string. Moreover, the spacers may be axially displaced relative to the pull-out string by rotating the spacers.

The spacer may comprise a contact portion, a first portion attached to a first attachment member rotatably attached to the pull-out string and a second portion attached to a second attachment member rotatably attached to the pull-out string, wherein the first portion is rotatably attached to the second portion, wherein the contact portion is radially displaced when the distance between the first attachment member and the second attachment member is changed.

Hereby, it is possible to adjust the geometrical configuration of the spacer in order to optimise it individually.

An aspect of the present disclosure relates to an assembly comprising a hearing aid device and a spacer. The hearing aid device may be configured to be inserted at least partially into the ear canal of a wearer. This may be completely in the ear canal, such as into the bony region of the ear canal. The hearing aid device may comprise a pull-out string. The pull-out string may be configured so that the wearer is able to pull the hearing aid device out of the ear canal. Further, the pull-out string may be used by the wearer to position the hearing aid device into the ear canal.

When providing wireless communication between a hearing aid device positioned in the ear canal of a wearer to an external unit, and especially when using relatively high frequencies for communication, it is advantageous to positioned an antenna attached to the pull-out string or integrated in the pull-out string. This allows for an elongate antenna to be positioned in the ear canal of the user, possibly with a minor part near the ear canal entrance or even just outside of the ear canal. The electromagnetic signals from the antenna, e.g. at GHz frequencies, will be influenced by the head of the user, i.e. the head will most likely degrade the signal as a part of the signal will be absorbed by the head at these frequencies. For even further enhancing the performance of the antenna it will be advantageous to provide at least one spacer comprising a contact portion adapted for being brought into contact with the wall of the ear canal of the wearer and this spacer will then, during use, maintain the antenna in a distance from the wall of the ear canal. This could e.g. be by centering the pull-out string in the ear canal, at least in the area where the spacer is placed. This will also depend on the stiffness of the pull-out string. More than one spacer could be positioned along the length of the pull-out string. The spacer could comprise any or all features mentioned throughout the present specification. The wireless communication may include using a data protocol such as Bluetooth, Bluetooth low energy, any standardized or any proprietary protocol.

An aspect of the present disclosure thus relates to a system comprising a hearing aid device for being positioned completely in the ear canal of a wearer, the hearing aid device comprising a wireless interface for communicating with external units, an extractor cord, or pull-out string, an antenna in the extractor cord, and a spacer configured to maintain at least a part of the extractor cord from contacting the skin of the wearer when the hearing aid device is positioned in the ear canal of the wearer.

Moreover, a spacer as defined in the present discloser could be used in connection with a so-called receiver-in-the-ear hearing aid device having an antenna incorporated at least in part in the connection between the behind-the-ear part and the in-the-ear part. In such as configuration one or more conductors in the connecting part could serve as at least part of the antenna. This could be one conductor or two conductors of the conductors connected to the speaker unit in the ear canal, a screen element, such as an element at least partly screening audio-carrying wires from higher frequency radiation to or from the hearing aid device. It could also be a dedicated element acting as an antenna. Further, it could be a part, e.g. the outer conductor of a coaxial connection, of a number of electrically conductive elements connecting the behind-the-ear part to the in-the-ear part. A spacer as disclosed in the present specification could be utilized to ensure that at the part of the connector entering the ear canal no part, or at least a very small part, of the connector would come into contact with the ear canal. Hereby either none, or at least a limited, contact between the head and the connector could be ensured, thereby enhancing antenna performance.

Thus, an aspect of the present disclosure relates to a system comprising a hearing aid device having a behind-the-ear part and an in-the-ear part, and a connector member mechanically connecting the behind-the-ear part and the in-the-ear part, the hearing aid device comprising a wireless interface for communicating with external units, an antenna at least partly in the connector member, and a spacer configured to maintain at least a part of the connector member from contacting the skin of the ear canal of the wearer when the hearing aid device is positioned at an ear of the wearer. The spacer may comprise any or all features of the spacers disclosed in the present specification. Further, multiple spacer may be used.

If a material, e.g. grid material or the like, that are transparent to audio is used for the spacer or spacers, an input transducer configured to sense audio in the environment outside the ear canal may be included in the in-the-ear part.

BRIEF DESCRIPTION OF THE DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effects will be apparent from and elucidated with reference to the illustrations described hereinafter in which:

FIG. 3A shows a schematic perspective view of a spacer;

FIG. 3B shows a front view of the spacer shown in FIG. 3A;

FIG. 3C shows a schematic perspective view of a spacer;

FIG. 3D shows a front view of the spacer shown in FIG. 3C;

FIG. 3E shows a schematic perspective view of a spacer;

FIG. 3F shows a front view of the spacer shown in FIG. 3E;

DETAILED DESCRIPTION OF THE DRAWINGS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus are described by various blocks, functional units, modules, components, steps, processes etc. (collectively referred to as "elements"). Depending upon the particular application, design constraints or other reasons, these elements may be implemented using electronic hardware, computer programs, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer programs shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing device may be a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device adapted to receive an audio signal electronically, possibly modifying the audio signal and providing the possibly modified audio signals as an audible signal to at least one of the user's ears. Such audible signals may be provided in the form of an acoustic signal radiated into the user's outer ear.

The hearing device is adapted to be arranged in the ear canal of the user. The hearing device may be an In-the-Ear type hearing aid or an In-the-Canal/Completely-in-Canal type hearing aid.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

Figure 1A:
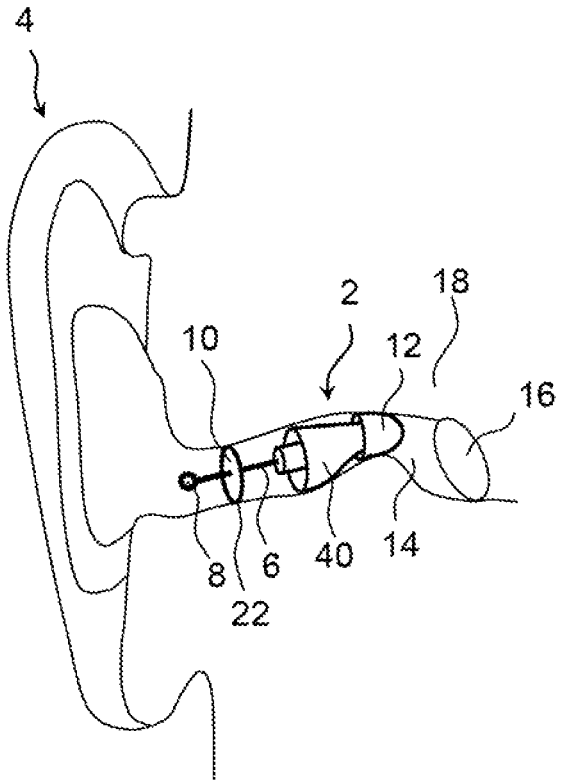
FIG. 1A shows a schematic view of a hearing device.

The input unit may include multiple input microphones, e.g. for providing direction-dependent audio signal processing. Such a directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include an amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal Referring now in detail to the drawings of the disclosure, FIG. 1A illustrates a schematic view of a hearing device 2. The hearing device 2 is a completely-in-canal (CIC) hearing device arranged in the ear canal 14 of the user of the hearing device 2. The hearing device 2 is positioned in a distance to the ear drum 16 providing the most optimum hearing experience for the user. The hearing device 2 is arranged in the bony region 18 of the ear canal 14.

The hearing device 2 comprises a body portion and a dome 12 attached to the distal portion of the body portion 40. An antenna is integrated in a pull-out string 6 attached to the proximal end of the body portion 40.

The pull-out string 6 is provided with a nail grip 8 in its distal end. A spacer 10 is provided at the central portion of the pull-out string 6. The nail grip 8 allows the user to grip the pull-out string 6 by the fingers from the outside of the ear 4.

The spacer 10 comprises a peripheral contact portion 22 adapted to be brought into contact with the ear canal 14 and hereby maintain the pull-out string 6 fixed centrally in the ear canal 14.

Accordingly, the spacer 10 ensures that the antenna integrated in the pull-out string 6 has a minimum distance to the wall of the ear canal 14.

Thereby, the pull-out string 6 and the antenna integrated in the pull-out string 6 may be kept from the wall of the ear canal 14 so that the antenna's coupling to the tissue may be, better, controlled.

The spacer 10 shown in FIG. 1A is disk-shaped having a circular cross-section; however, the spacer 10 may have other geometric shapes.

The spacer 10 allows audio to pass through it. This is possible due to vent holes (not shown) provided in the spacer 10 or by choosing materials (e.g. grid material) that are transparent to audio.

Figure 1B:
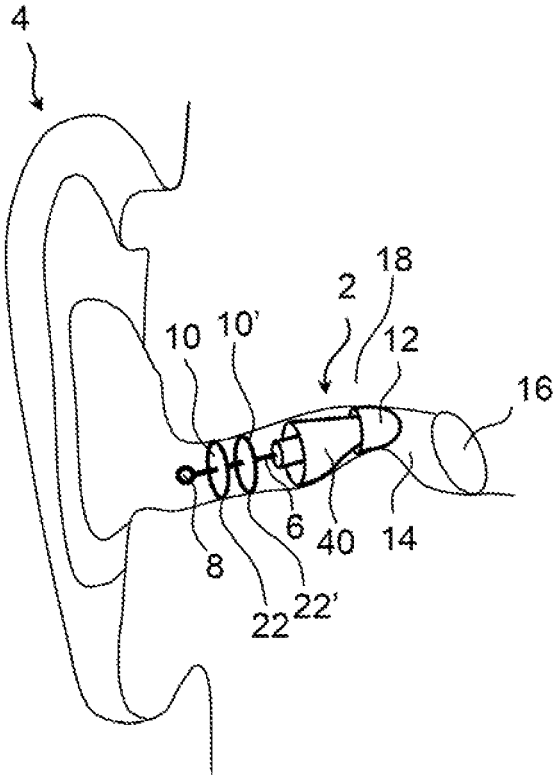
FIG. 1B shows a schematic view of a hearing device.

FIG. 1B illustrates a schematic view of a hearing device 2. The hearing device 2 almost corresponds to the one illustrated in FIG. 1A, however, the pull-out string 6 comprises two spacers 10, 10'.

The spacers 10, 10' are identical; however, it may be possible to apply spacers 10, 10' of different shape and size. The spacers 10, 10' extend parallel to each other and each of them comprises a peripheral contact portion 22, 22' that has been brought into contact with the ear canal 14. Hereby, the spacers 10, 10' are capable of maintaining the pull-out string 6 fixed centrally in the ear canal 14. Therefore, pull-out string 6 may be kept from the wall of the ear canal 14. If an antenna is integrated in the pull-out string, the antenna's coupling to the tissue may be controlled by means of the spacers 10, 10'.

Figure 2B:
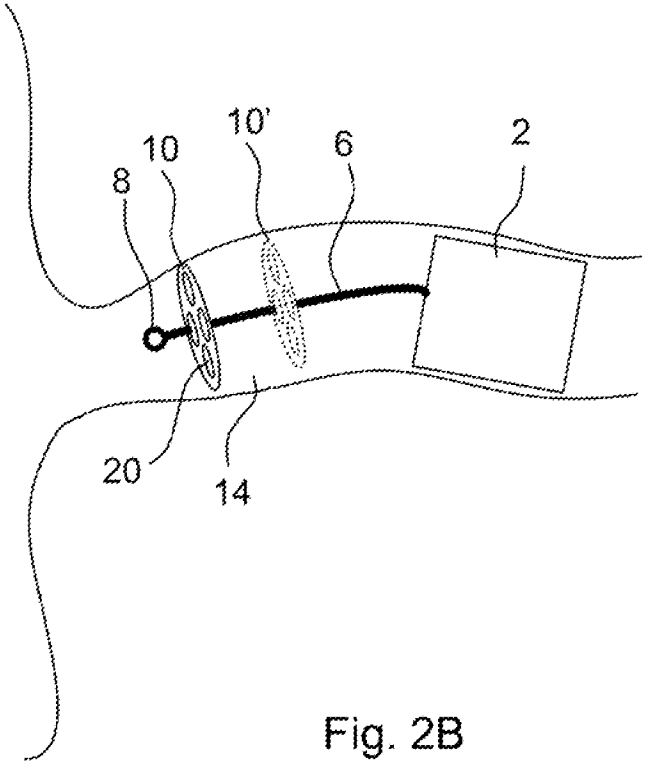
FIG. 2B shows a hearing device that basically corresponds to the one shown in FIG. 2A.
Figure 2A:
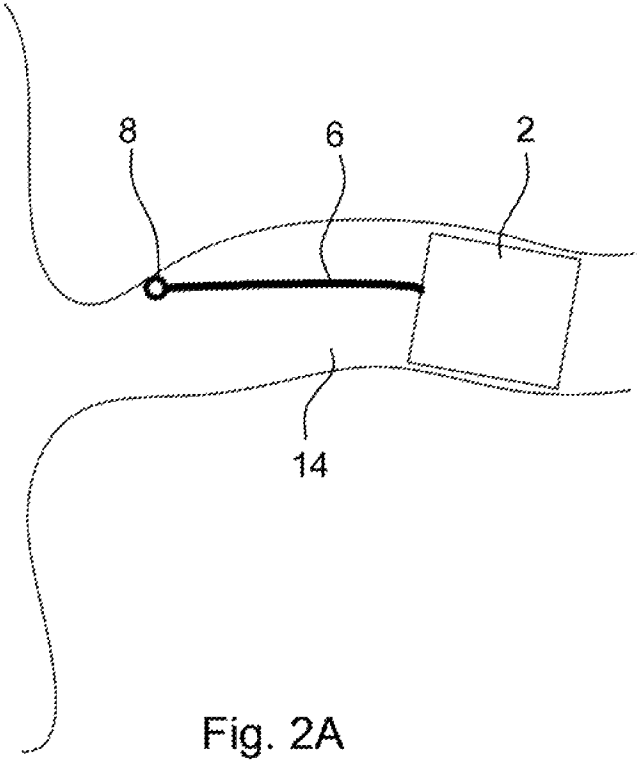
FIG. 2A shows a schematic view of a hearing device comprising a pull-out string attached to the proximal end of a hearing aid device.

FIG. 2A illustrates a schematic view of a hearing device 2 comprising a pull-out string 6 attached to the proximal end of the hearing device 2. A nail grip 8 is provided in the distal end of the pull-out string 6.

The nail grip 8 is in contact with the wall of the ear canal 14. An antenna is integrated in the pull-out string 6, and since the pull-out string 6 is not kept in a distance from the ear canal, the antenna transfers energy via antenna coupling to the ear canal wall tissue.

The antenna may be mechanically attached to the pull-out string 6 or be arranged within a track or canal extending along the length of the pull-out string 6.

Due to variation of ear canals 14 among different users, it is difficult to control the position and orientation of the pull-out string 6 and thus the antenna of the pull-out string 6. As it may be seen in FIG. 2A, the the antenna is arranged in a position in which it can transfer energy via antenna coupling to the ear canal wall tissue that can raise tissue temperatures. One effective way to decrease this energy coupling is to increase the separation between the antenna and the ear canal wall tissue.

Accordingly, it is desired to arrange the pull-out string 6 (and thus the antenna) in a distance from the walls of the ear canal 14.

FIG. 2B illustrates a hearing device 2 that basically corresponds to the one shown in FIG. 2 A. The hearing device 2, however, is provided with a first spacer 10 and a second spacer 10' configured to separate the pull-out string 6 (and thus the antenna in the pull-out string 6) from the wall of the ear canal wall 14.

The hearing device 2 is an Invisible In-the-Canal (IIC) type hearing device 2 that is invisible from the outside.

The first spacer 10 and the second spacer 10' are shaped as thin disks provided with a number of vent holes 20 that allows audio signals to pass freely through the spacers 10, 10'. Each spacer 10, 10' is provided with a centre opening 26 through which the pull-string 6 extends.

FIG. 3A illustrates a schematic perspective view of a spacer 10. The spacer 10 is disk-shaped and has a circular cross-section. The spacer 10 comprises a centre opening 26 provided as a centrally arranged through bore.

Although not shown, the centre opening 26 may be threaded in order to be configured to receive an engaging threaded rod member of a pull-out string. Recesses or protrudings having another shape may be provided in the centre opening 26 in order to allow for mechanical engagement with the rod member of a pull-out string.

The spacer 10 comprises a plurality of vent openings 20 arranged between the centre opening 26 and the periphery of the spacer 10. The periphery of the spacer 10 functions as contact portion 22 configured to be brought into contact with the wall of the ear canal.

FIG. 3B illustrates a front view of the spacer 10 shown in FIG. 3A. The vent holes 20 are distributed around the centre opening 26 between the centre opening 26 and the periphery of the spacer 10.

FIG. 3C illustrates a schematic perspective view of a spacer 10. The spacer 10 comprises four arm members 24, 24' that basically constitute a cross. Each of the four arm members 24, 24' extend perpendicular to the adjacent arm member 24, 24'.

The basically cross-shaped spacer 10 comprises a centre opening 26 provided as a centrally arranged through bore. The through bore may be threaded in to receive an engaging threaded rod member of a pull-out string.

Each arm member 24, 24' is provided with a vent hole 20. It is, however, possible to produce the cross-shaped spacers 10 without these vent holes 20.

The distal portion of each arm member functions as contact portion 22 configured to be brought into contact and thus bear against the wall of the ear canal.

FIG. 3D illustrates a front view of the spacer 10 shown in FIG. 3C. It may be seen that the vent holes 20 are evenly distributed around the centre opening 26.

FIG. 3E illustrates a schematic perspective view of a spacer 10. The spacer 10 comprises six arm members 24, 24' arranged in a star configuration. The six arm members 24, 24' are evenly distributed in such a manner that the angle between the longitudinal axes of adjacent arm members 24, 24' is approximately 60 degrees.

The star-shaped spacer 10 comprises a centre opening 26 configured to receive a rod member of a pull-out string. The distal portion of each arm member 24, 24' functions as contact portion 22 configured to be brought in to contact and thus bear against the wall of the ear canal.

FIG. 3F illustrates a front view of the spacer 10 shown in FIG. 3E. It may be seen that the vent holes 20 are evenly distributed around the centre opening 26.

Figure 4A:
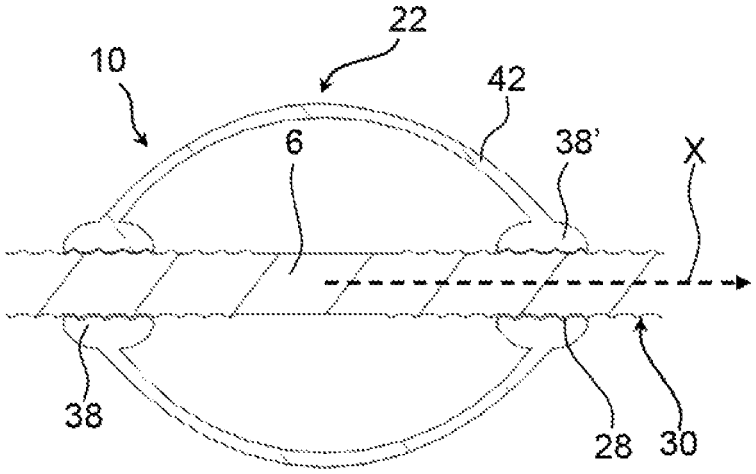
FIG. 4A shows a cross-sectional view of a spacer.

FIG. 4A illustrates a cross-sectional view of a spacer 10. The spacer 10 comprises a first attachment member 38 and a second attachment member 38' each provided with a threaded through bore configured to receive a threaded pull-out string 6 with a threaded portion 30 adapted to engage with the threads of the attachment members 38, 38'. The through bore is provided with a threaded portion 28.

The spacer 10 comprises a wall member 42 connecting the first attachment member 38 and a second attachment member 38'. That portion of the wall member 42 that has the longest distance to the pull-out string 6 constitutes a contact portion 22 configured to be brought into contact with the wall of the ear canal. Hereby, the spacer 10 is capable of providing the pull-out string in a minimum distance from the wall of the ear canal.

Accordingly, by turning the spacer 10, it is possible to displace the spacer 10 along the longitudinal axis X of the spacer 10. Hereby, it is possible to change the orientation of the spacer 10 relative to the pull-out string 6.

The attachment members 38, 38' and the pull-out string 6 may be provided without threads. It is possible to apply attachment members 38, 38' and a pull-out string 6 provided with other engagement members than treads (e.g. recesses or protrusions).

Figure 4B:
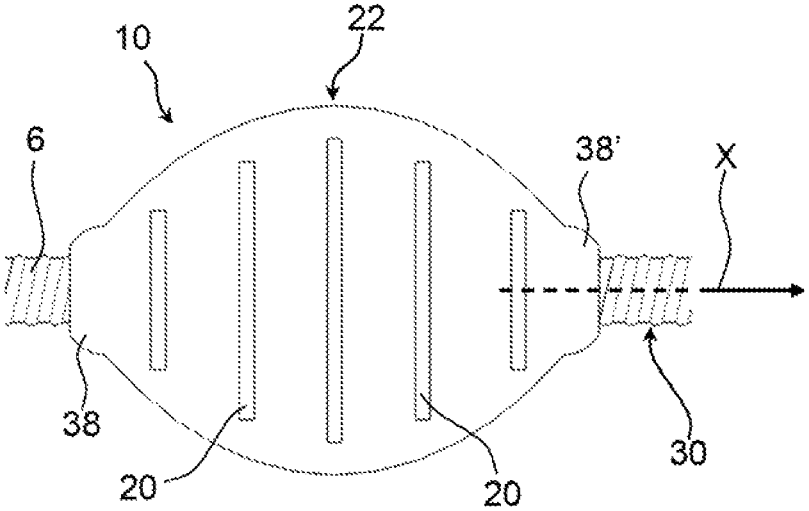
FIG. 4B shows a schematic side view of a spacer.

FIG. 4B illustrates a schematic side view of a spacer 10. The spacer 10 corresponds to the one shown in FIG. 4A.

It may be seen that the spacer 10 is mechanically attached to a pull-out string 6 equipped with a threaded portion 30. The attachment members 38, 38' have a threaded through bore that engages the threaded portion 30 of the pull-out string 6. Accordingly, rotation of the spacer 10 about the pull-out string 6 will cause a displacement of the spacer along the longitudinal axis X of the pull-out string 6.

The spacer 10 has a basically oval shape and comprises a contact portion 22 configured to be brought in to contact and thus bear against the wall of the ear canal. When the contact portion 22 has been brought into contact with the wall of the ear canal, the spacer 10 will secure that the pull-off string 6 is kept at a minimum distance from the wall of the ear canal.

The spacer 10 is provided with a plurality of elongated vent holes 20. These vent holes may be varied in size and shape in order to allow audio signals to freely pass through the spacer 10.

Figure 4C:
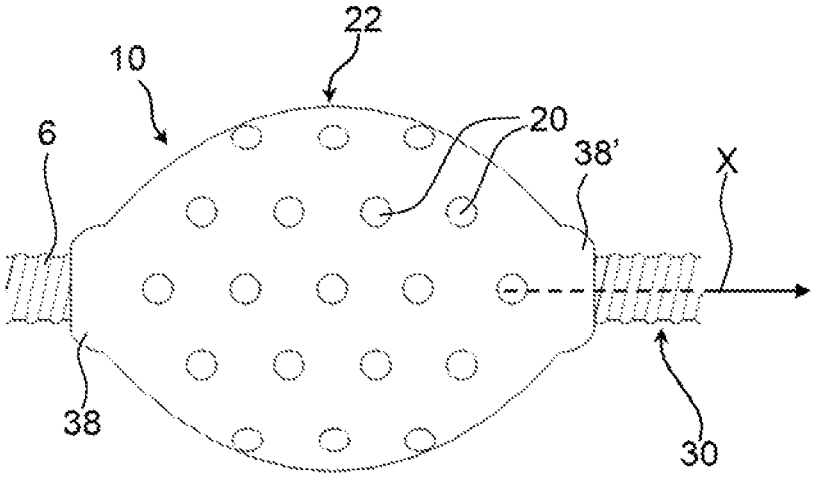
FIG. 4C shows a schematic side view of a spacer.

FIG. 4C illustrates a schematic side view of a spacer 10. The spacer 10 is displaceably attached to a pull-out string 6 equipped with a threaded portion 30. The spacer 10 comprises two attachment members 38, 38' each provided with a threaded through bore engaging the threaded portion 30 of the pull-out string 6.

Turning the spacer 10 about the pull-out string 6 will cause a displacement of the spacer 10 along the longitudinal axis X of the pull-out string 6. In this way, it is possible to displace the spacer 10 along the longitudinal axis X of the pull-out string 6.

The spacer 10 has an essentially oval shape and is equipped with a contact portion 22 adapted to be brought into contact with the wall of the ear canal so that the pull-off string 6 may be maintained in a position in which a minimum distance is kept from the wall of the ear canal.

The spacer 10 is provided with a plurality of vent holes 20. These vent holes have a circular geometry; however, they may be varied in size and shape in order to allow audio signals to freely pass through the spacer 10.

Figure 5A:
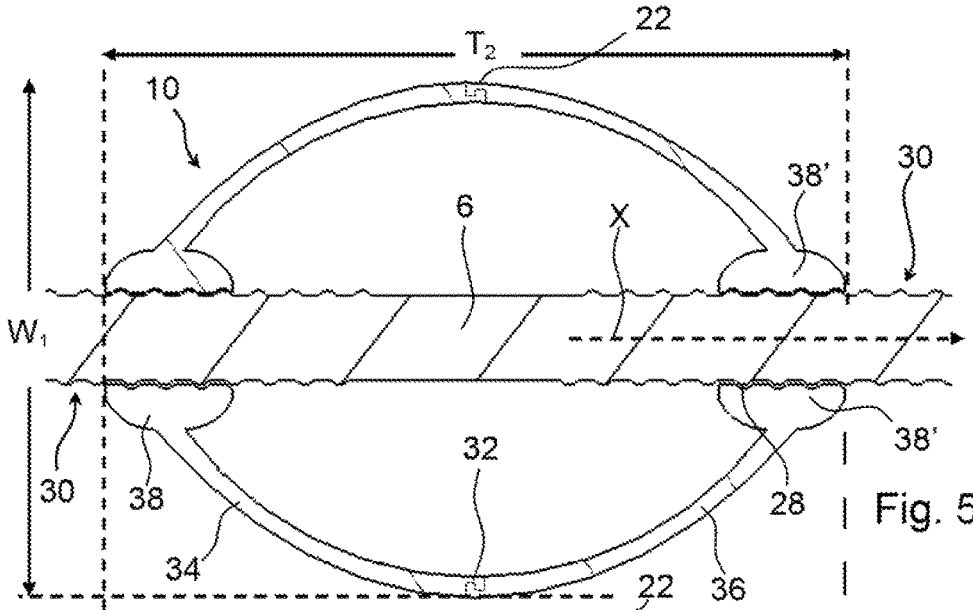
FIG. 5A shows a cross-sectional view of a spacer.
Figure 5B:
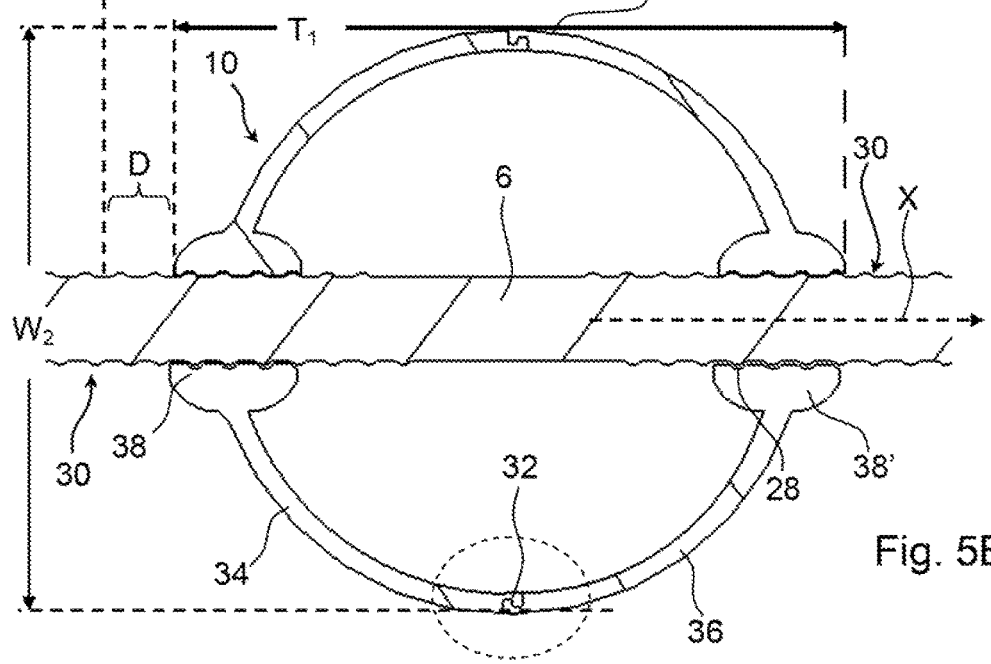
FIG. 5B shows a cross-sectional view of the spacer shown in FIG. 5A in another configuration and FIG. 5C shows a close-up view of the joint shown in FIG. 5A and in FIG. 5B.

FIG. 5A and FIG. 5B illustrate cross-sectional views of a spacer 10. The spacer 10 basically corresponds to the one shown in FIG. 4A, however the wall member is separated into a first portion 34 and a second portion 36 rotatably attached to the first portion 34 by means of a joint 32.

The spacer 10 comprises a first attachment member 38 and a second attachment member 38' each comprising a through bore provided with a threaded portion 28.

A pull-off string 6 provided with a threaded portion 30 extends through the spacer 10.

The spacer 10 is rotatably mounted to the pull-out string 6. Accordingly, the axial position of the spacer 10 may be adjusted by rotating the spacer about the pull-out string 6. Hereby, the spacer 10 will be displaced along the longitudinal axis X of the pull-out string 6.

In FIG. 5A, the thickness $T_2$ and the width $W_1$ of the spacer 10 is defined by the distance between the first attachment member 38 and a second attachment member 38'. Comparing with FIG. 5 B, it may be seen that the width $W_2$ of the spacer 10 is increased, whereas the thickness $T_1$ is reduced. This configuration is achieved by rotating the first portion 34 relative to the second portion 36 and hereby decreasing the distance between the first portion 34 and the second portion 36.

The spacer shown in FIG. 5A and in FIG. 5B allows for adjustment of the width $W_1$, $W_2$ by rotating the first portion 34 relative to the second portion 36 in order to increase or decrease the distance between the first portion 34 and the second portion 36. Hereby, the contact portion 22 will be radially displaced. Accordingly, it is possible to adjust the spacer 10 individually and make it fit to the ear canal of the user of the hearing device in which the pull-out string 6 is used.

Figure 5C:
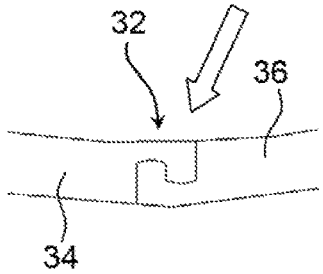

FIG. 5C illustrates a close-up view of the joint shown in FIG. 5A and in FIG. 5B. It may be seen that the joint is defined by abutting portions of the first portion 34 and the second portion 36.

In all the pull-out strings shown in the figures, an antenna may be provided. The antenna may be attached to the pull-out string e.g. in a recess or a through bore.

The above-disclosed features relating to an in-the-canal device where a spacer is applied to ensure that the extractor cord, or pull-out string, is maintained separated from the wall of the ear canal is equally applicable to a system where a behind-the-ear device is connected to an in-the-ear device, such as a hearing aid in a so-called RITE configuration, where an antenna is at least partly included in the part connecting the in-the-ear part and the behind the-ear-part. In such a system the spacer will help ensure that as small a part as possible of the connector/antenna is in contact with the skin of the wearer's ear canal, thereby alleviating losses due to coupling between the antenna and the user's skin in the ear canal. Even though it will not eliminate losses due to skin and/or bone and/or tissue in the head, it will reduce the loss thereby increasing the performance of the antenna, especially when communicating in the GHz range, such as around 2.4 GHz, or 5.1 GHz, such as in the ISM band. Optionally using a protocol such as Bluetooth or based on Bluetooth.

The present disclosure relates at least to the following number of points:

1. A spacer attached to or being configured to be attached to a pull-out string (6) for a hearing device, wherein the spacer comprises a contact portion adapted for being brought into contact with the wall of the ear canal of a hearing device user and hereby maintain the pull-out string in a distance from the wall of the ear canal.
2. A spacer according to point 1, wherein the spacer has a round or oval periphery.
3. A spacer according to point 1, wherein the spacer comprises a plurality of radially extending arm members.
4. A spacer according to one of the preceding points, wherein the spacer is transparent to audio frequency sound waves.
5. A spacer according to one of the preceding points, wherein the spacer is provided with a number of vent holes.
6. A hearing device comprising a pull-out string and at least one spacer according to one of the preceding points, wherein an antenna is attached to the pull-out string or integrated in the pull-out string.
7. A hearing device according to point 6, wherein the hearing device comprises a body portion, wherein the antenna extends at least partly through the length of the pull-out string and where the antenna extends through at least a portion of the body portion of the hearing device.
8. A hearing device according to point 6 or point 7, wherein at least a portion of the antenna is coiled.

9. A hearing device according to one of the preceding points 6-8, wherein the pull-out-string comprises round or oval periphery.
10. A hearing device according to one of the preceding points 6-9, wherein at least one spacer is fixedly attached to the pull-out string.
11. A hearing device according to one of the preceding points 6-10, wherein at least one spacer is moveably attached to the pull-out string.
12. A hearing device according to one of the preceding points 6-11, wherein the pull-out string comprises a spacer fixed to the pull-out string by means of a number of attachment portions provided on the pull-out string and a number of corresponding engaging attachment portions provided at the spacer.
13. A hearing device according to one of the preceding points 6-12, wherein one or more spacers are rotatably attached to the pull-out string.
14. A hearing device according to one of the preceding points 6-13, wherein the pull-out string comprises a threaded portion, wherein one or more spacers comprise a threaded bore configured to engagingly receive the threaded portion of the pull-out string.
15. A hearing device according to one of the preceding points 6-14, wherein the spacer comprises a contact portion, a first portion attached to a first attachment member rotatably attached to the pull-out string and a second portion attached to a second attachment member rotatably attached to the pull-out string, wherein the first portion is rotatably attached to the second portion, wherein the contact portion is radially displaced when the distance between the first attachment member and the second attachment member is changed.

Throughout the present description the spacer have been described in relation to an in-the-ear hearing device, alternatively, the spacer may be used in conjunction with a behind-the-ear part and an in the ear As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it may be directly connected or coupled to the other element, but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

LIST OF REFERENCE NUMERALS

2 Hearing device
4 Ear
6 Pull-out string
8 Nail grip
10, 10' Spacer
12 Dome
14 Ear canal
16 Eardrum
18 Bony region
20 Vent hole
22, 22' Contact portion
24, 24' Arm member
26 Centre opening
28 Thread portion
30 Threaded portion
D Distance
X Longitudinal axis
$W_1$, $W_2$ Width
$T_1$, $T_2$ Thickness
32 Joint
34 First portion
36 Second portion
38, 38' Attachment member
40 Body portion
42 Wall member

The invention claimed is:

1. A completely-in-canal (CIC) hearing aid device whose electronics and other components are configured to be entirely disposed within the ear canal of a wearer during use, the CIC hearing device comprising:
- a housing configured to be inserted completely into the ear canal of a wearer;
- a pull-out string attached to the housing, the pull-out string being configured to allow the wearer to extract the housing from the ear canal;
- an antenna attached to the pull-out string or integrated in the pull-out string, with the remaining electronics of the CIC hearing aid device being enclosed within the housing; and
- at least one spacer comprising a contact portion adapted for being brought into contact with the wall of the ear canal of the wearer, said at least one spacer being configured, during use, to maintain the antenna in a distance from the wall of the ear canal.

2. The CIC hearing aid device according to claim 1, the spacer has a round or oval periphery.

3. The CIC hearing aid device according to claim 2, wherein the spacer is transparent to audio frequency sound waves.

4. The CIC hearing aid device according to claim 2, wherein the spacer is provided with a number of vent holes.

5. The CIC hearing aid device according to claim 1, wherein the spacer comprises a plurality of radially extending arm members.

6. The CIC hearing aid device according to claim 5, wherein the spacer is transparent to audio frequency sound waves.

7. The CIC hearing aid device according to claim 5, wherein the spacer is provided with a number of vent holes.

8. The CIC hearing aid device according to claim 1, wherein the spacer is transparent to audio frequency sound waves.

9. The CIC hearing aid device according to claim 8, wherein the spacer is provided with a number of vent holes.

10. The CIC hearing aid device according to claim 1, wherein the spacer is provided with a number of vent holes.

11. The CIC hearing aid device according to claim 1, wherein the antenna is operated at a center frequency in the range 1 GHz to 10 GHz.

12. The CIC hearing aid device according to claim 1, wherein the antenna extends at least partly through the length of the pull-out string and where the antenna extends through at least a portion of the housing of the hearing aid device.

13. The CIC hearing aid device according to claim 1, wherein at least a portion of the antenna is coiled.

14. The CIC hearing aid device according to claim 1, wherein the pull-out-string comprises round or oval periphery.

15. The CIC hearing aid device according to claim 1, wherein at least one spacer is fixedly attached to the pull-out string, optionally the at least one spacer is fixed in axially relation to the pull-out string.

16. The CIC hearing aid device according to claim 1, wherein at least one spacer is moveably attached to the pull-out string.

17. The CIC hearing aid device according to claim 1, wherein one of the at least one spacer is fixed to the pull-out string by means of a number of attachment portions provided on the pull-out string and a number of corresponding engaging attachment portions provided at the one of the at least one spacer.

18. The CIC hearing aid device according to claim 1, wherein one or more spacers are rotatably attached to the pull-out string.

19. A hearing aid device having a housing configured to be inserted completely into the ear canal of a wearer, wherein the housing comprises a pull-out string configured to allow the wearer to extract the housing from the ear canal, wherein an antenna is attached to the pull-out string or integrated in the pull-out string, wherein at least one spacer comprising a contact portion adapted for being brought into contact with the wall of the ear canal of the wearer and, during use, hereby maintain the antenna in a distance from the wall of the ear canal, and wherein the pull-out string comprises a threaded portion, wherein one or more spacers comprise a threaded bore configured to engagingly receive the threaded portion of the pull-out string.

20. A hearing aid device having a housing configured to be inserted completely into the ear canal of a wearer, wherein the housing comprises a pull-out string configured to allow the wearer to extract the housing from the ear canal, wherein an antenna is attached to the pull-out string or integrated in the pull-out string, wherein at least one spacer comprising a contact portion adapted for being brought into contact with the wall of the ear canal of the wearer and, during use, hereby maintain the antenna in a distance from the wall of the ear canal, and wherein the spacer comprises a contact portion, a first portion attached to a first attachment member rotatably attached to the pull-out string and a second portion attached to a second attachment member rotatably attached to the pull-out string, wherein the first portion is rotatably attached to the second portion, wherein the contact portion is radially displaced when the distance between the first attachment member and the second attachment member is changed.

* * * * *